US006412465B1

(12) United States Patent
Lykowski et al.

(10) Patent No.: US 6,412,465 B1
(45) Date of Patent: Jul. 2, 2002

(54) IGNITION DEVICE HAVING A FIRING TIP FORMED FROM A YTTRIUM-STABILIZED PLATINUM-TUNGSTEN ALLOY

(75) Inventors: James D. Lykowski, Temperance, MI (US); Kenneth R. Heuker, Toledo, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/626,759

(22) Filed: Jul. 27, 2000

(51) Int. Cl.[7] ..... H01T 13/20

(52) U.S. Cl. ..... 123/169 EL; 313/141; 445/7

(58) Field of Search ..... 123/169 R, 169 EL; 313/141, 142, 118; 445/7, 46

(56) References Cited

U.S. PATENT DOCUMENTS

| | | | | |
|---|---|---|---|---|
| 3,547,712 A | | 12/1970 | Bourne et al. | 148/513 |
| 3,738,817 A | | 6/1973 | Benjamin | 75/235 |
| 3,778,249 A | | 12/1973 | Benjamin et al. | 75/232 |
| 3,974,001 A | | 8/1976 | Steinemann et al. | 148/400 |
| 3,994,718 A | | 11/1976 | Berndt et al. | 420/1 |
| 4,081,710 A | | 3/1978 | Heywood et al. | 313/141 |
| 4,082,547 A | | 4/1978 | Berndt et al. | 420/1 |
| 4,229,672 A | | 10/1980 | Trancik | 313/139 |
| 4,402,746 A | | 9/1983 | Ramanarayanan et al. | 75/252 |
| 4,427,447 A | | 1/1984 | Ramanarayahan et al. | 75/252 |
| 4,507,156 A | | 3/1985 | Roehrig | 148/678 |
| 4,540,910 A | | 9/1985 | Kondo et al. | 313/11.5 |
| 4,798,625 A | | 1/1989 | Jongenburger et al. | 75/235 |
| 5,077,141 A | | 12/1991 | Naik et al. | 428/680 |
| 5,347,193 A | | 9/1994 | Oshima et al. | 313/141 |
| 5,456,624 A | | 10/1995 | Moore et al. | 445/7 |
| 5,461,275 A | | 10/1995 | Oshima | 313/141 |
| 5,478,265 A | | 12/1995 | Matsutani et al. | 445/7 |
| 5,497,045 A | | 3/1996 | Matsutani et al. | 313/141 |
| 5,514,929 A | | 5/1996 | Kawamura | 313/141 |
| 5,779,842 A | | 7/1998 | Fawcett et al. | 156/250 |
| 5,877,584 A | | 3/1999 | Kato et al. | 313/143 |
| 5,894,186 A | * | 4/1999 | Matsutani et al. | 313/141 |
| 5,990,602 A | | 11/1999 | Katoh et al. | 313/141 |
| 6,007,645 A | | 12/1999 | Cetel et al. | 148/404 |
| 6,045,424 A | | 4/2000 | Chang et al. | 445/7 |
| 6,064,143 A | | 5/2000 | Kagawa | 313/141 |
| 6,071,163 A | | 6/2000 | Chang et al. | 445/7 |
| 6,078,129 A | | 6/2000 | Gotou et al. | 313/141 |
| 6,094,000 A | | 7/2000 | Osamura et al. | 313/141 |
| 6,225,752 B1 | | 5/2001 | Matsubara et al. | 315/209 M |

FOREIGN PATENT DOCUMENTS

| | | | | |
|---|---|---|---|---|
| JP | 58-34151 | * | 2/1983 | H01T/13/20 |
| JP | 61-26748 | * | 2/1986 | H01T/13/39 |
| JP | 11-12670 | * | 1/1999 | H01T/13/39 |

* cited by examiner

*Primary Examiner*—John Kwon
*Assistant Examiner*—Hien T. Vo
(74) *Attorney, Agent, or Firm*—Reising, Ethington, Barnes, Kisselle, Learman & McCulloch, P.C.

(57) ABSTRACT

A spark plug having ground and center electrodes that include a firing tip formed from an alloy containing platinum, tungsten, and yttrium oxide. The firing tip can take the form of a pad, rivet, ball, wire, or other shape and can be welded in place on the electrode. The firing tip provides good erosion resistance, a reduced sparking voltage, good welding and forming characteristics, as well as a minimal occurrence of oxidation of the alloy at the weld area. Desirable ranges of the relative amounts of platinum, tungsten, and yttrium are also disclosed.

20 Claims, 1 Drawing Sheet

IGNITION DEVICE HAVING A FIRING TIP FORMED FROM A YTTRIUM-STABILIZED PLATINUM-TUNGSTEN ALLOY

TECHNICAL FIELD

This invention relates generally to spark plugs and other ignition devices used in internal combustion engines and, more particularly, to such ignition devices having noble metal firing tips. As used herein, the term "ignition device" shall be understood to include spark plugs, igniters, and other such devices that are used to initiate the combustion of a gas or fuel.

BACKGROUND OF THE INVENTION

Within the field of spark plugs, there exists a continuing need to improve the erosion resistance and reduce the sparking voltage at the spark plug's center and ground electrodes. To this end, various designs have been proposed using noble metal electrodes or, more commonly, noble metal firing tips applied to standard metal electrodes. Typically, the firing tip is formed as a pad or rivet which is then welded onto the end of the electrode.

Platinum and iridium alloys are two of the noble metals most commonly used for these firing tips. See, for example, U.S. Pat. No. 4,540,910 to Kondo et al. which discloses a center electrode firing tip made from 70 to 90 wt % platinum and 30 to 10 wt % iridium. As mentioned in that patent, platinum-tungsten alloys have also been used for these firing tips. Such a platinum-tungsten alloy is also disclosed in U.S. Pat. No. 6,045,424 to Chang et al., which further teaches the construction of firing tips using platinum-rhodium alloys and platinum-iridium-tungsten alloys.

Apart from these basic noble metal alloys, oxide dispersion strengthened alloys have also been proposed which utilize combinations of the above-noted metals with varying amounts of different rare earth metal oxides. See, for example, U.S. Pat. No. 4,081,710 to Heywood et al. In this regard, several specific platinum and iridium-based alloys have been suggested which utilize yttrium oxide ($Y_2O_3$). In particular, U.S. Pat. No. 5,456,624 to Moore et al. discloses a firing tip made from a platinum alloy containing <2% yttrium oxide. U.S. Pat. No. 5,990,602 to Katoh et al. discloses a platinum-iridium alloy containing between 0.01 and 2% yttrium oxide. U.S. Pat. No. 5,461,275 to Oshima discloses an iridium alloy that includes between 5 and 15% yttrium oxide. While the yttrium oxide has historically been included in small amounts (e.g., <2%) to improve the strength and/or stability of the resultant alloy, the Oshima patent teaches that, by using yttrium oxide with iridium at >5% by volume, the sparking voltage can be reduced.

SUMMARY OF THE INVENTION

The present invention is based on the finding that reduced erosion and lowered sparking voltages can be achieved at much lower percentages of yttrium oxide than are disclosed in the Oshima patent by incorporating the yttrium oxide into an alloy of tungsten and platinum.

Thus, in accordance with the invention there is provided an ignition device having both a ground and center electrode, wherein at least one of the electrodes includes a firing tip formed from an alloy containing platinum, tungsten, and yttrium oxide. Preferably, the alloy is formed from a combination of 91.7%–97.99% platinum, 2%–8% tungsten, and 0.01%–0.3% yttrium, by weight, and in an even more preferred construction, 95.68%–96.12% platinum, 3.8%–4.2% tungsten, and 0.08%–0.12% yttrium. The firing tip can take the form of a pad, rivet, ball, wire, or other shape and can be welded in place on the electrode.

In addition to good erosion resistance and a reduced sparking voltage, a firing tip constructed from the platinum/tungsten/yttrium oxide alloy provides a number of additional advantages, including good welding and forming characteristics, as well as a minimal occurrence of oxidation of the alloy at the weld area.

BRIEF DESCRIPTION OF THE DRAWINGS

A preferred exemplary embodiment of the present invention will hereinafter be described in conjunction with the appended drawings, wherein like designations denote like elements, and.

DESCRIPTION OF THE PREFERRED EMBODIMENT

Figure 1:
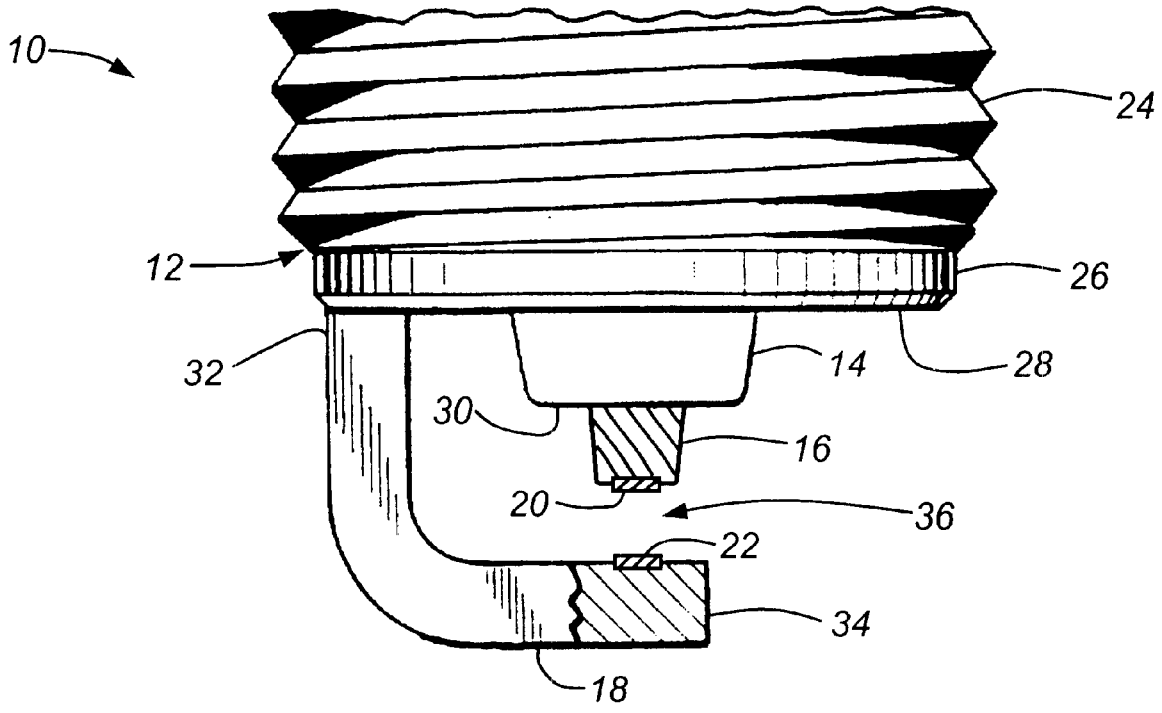
FIG. 1 is a fragmentary view and a partially cross-sectional view of a spark plug constructed in accordance with a preferred embodiment of the invention.

Referring to FIG. 1, there is shown the working end of a spark plug 10 that includes a metal casing or housing 12, an insulator 14 secured within the housing, a center electrode 16, a ground electrode 18, and a pair of firing tips 20, 22 located opposite each other on the center and ground electrodes 16, 18, respectively. Housing 12 can be constructed in a conventional manner and can include standard threads 24 and a annular lower end 26 to which the ground electrode 18 is welded or otherwise attached. Similarly, all other components of the spark plug 10 (including those not shown) can be constructed using known techniques and materials, excepting of course the ground and/or center electrodes 16, 18 which are constructed with firing tip 20 and/or 22, as will be described below.

As is known, the annular end 26 of housing 12 defines an opening 28 through which insulator 14 protrudes. Center electrode 16 is permanently mounted within insulator 14 by a glass seal or using any other suitable technique. It extends out of insulator 14 through an exposed, axial end 30. Ground electrode 18 is in the form of a conventional ninety-degree elbow that is mechanically and electrically attached to housing 12 at one end 32 and that terminates opposite center electrode 16 at its other end 34. This free end 34 comprises a firing end of the ground electrode 18 that, along with the corresponding firing end of center electrode 16, defines a spark gap 36 therebetween.

The firing tips 20, 22 are each located at the firing ends of their respective electrodes 16, 18 so that they provide sparking surfaces for the emission and reception of electrons across the spark gap 36. These firing ends are shown in cross-section for purposes of illustrating the firing tips which, in this embodiment, comprise pads welded into place on the firing tips. As shown, the firing tips 20, 22 can be welded into partial recesses on each electrode. Optionally, one or both of the pads can be fully recessed on its associated electrode or can be welded onto an outer surface of the electrode without being recessed at all.

In accordance with the invention, each firing tips is formed from an alloy containing platinum, tungsten, and yttrium oxide. Preferably, the alloy is formed from a combination of 91.7–97.99 wt % platinum, 2–8 wt % tungsten, and 0.01–0.3 wt % yttrium. In a highly preferred embodiment, the alloy is formed from 95.68–96.12 wt % platinum, 3.8–4.2 wt % tungsten, and 0.08–0.12 wt % yttrium.

The alloy can be formed by melting the desired amounts of platinum, tungsten, and yttrium together, with the yttrium oxidizing into yttrium oxide as a result of the alloying process. In this regard, it is worth noting that the percentages of yttrium specified herein are those of the yttrium when it is mixed with the platinum and tungsten, rather than that of the yttrium oxide in the resulting alloy. Accordingly, the alloy consists essentially of platinum, tungsten, and yttrium oxide and thus includes no more than trace amounts of anything else. Also, although the particular grain size of the yttrium oxide is not important, it is preferable that the yttrium oxide be finely divided and uniformly distributed throughout the alloy. After melting the platinum, tungsten, and yttrium together to initially form the alloy, it can then be converted into a powdered form by an atomization process, as is known to those skilled in the art. The powdered alloy can then be isostatically pressed into solid form, with secondary shaping operations being used if necessary to achieve the desired final form. Techniques and procedures for accomplishing these steps are known to those skilled in the art.

Although the electrodes can be made directly from the alloy, preferably they are separately formed from a more conventional electrically-conductive material, with the alloy being formed into firing tips for subsequent attachment to the electrodes. Once both the firing tips and electrodes are formed, the firing tips are then permanently attached, both mechanically and electrically, to their associated electrodes by welding or other suitable means. This results in the electrodes each having an integral firing tip that provides an exposed sparking surface for the electrode.

Figure 2:
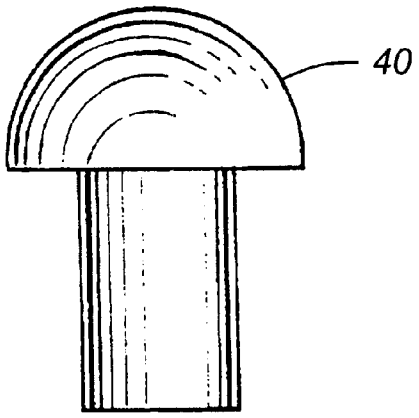
FIG. 2 is a side view of a rivet that can be used in place of the firing tip pads used on the spark plug of FIG. 1.
Figure 3:
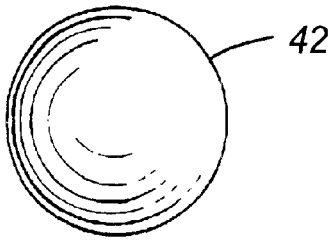
FIG. 3 depicts a ball that can be used in place of the firing tip pads of FIG. 1.

As will be appreciated, the firing tips 20, 22 need not be pads, but can take the form of a rivet 40 (shown in FIG. 2), a ball 42 (shown in FIG. 3), a wire (not shown), or any other suitable shape. Although a round-end rivet is shown in FIG. 2, a rivet having a conical or frusto-conical head could also be used. The construction and mounting of these various types of firing tips is known to those skilled in the art. Also, although the firing ends of both the center and ground electrodes are shown having a firing tip formed from the platinum/tungsten/yttrium alloy, it will be appreciated that the alloy could be used on only one of the electrodes.

The addition of the yttrium provides grain stabilization of the platinum/tungsten alloy and results in an overall alloy which permits electrons to be emitted more easily than many commonly-used alloys. This results in lowering of the voltage needed to spark across the gap 36. The alloy also provides good erosion resistance, especially at elevated temperatures. Furthermore, welding and forming of the firing tips has been found to be consistently good, while oxidation of the alloy at the weld area is minimal.

Although an upper limit of 0.3 wt % yttrium is preferably used, significantly higher percentages can be used; however, the resulting alloy will increase in hardness, making welding of the material more difficult.

It will thus be apparent that there has been provided in accordance with the present invention an ignition device and manufacturing method therefor which achieves the aims and advantages specified herein. It will, of course, be understood that the foregoing description is of preferred exemplary embodiments of the invention and that the invention is not limited to the specific embodiments shown. Various changes and modifications will become apparent to those skilled in the art. For example, although an ignition device in the form of a spark plug has been illustrated, it will be appreciated that the invention can be incorporated into an igniter of the type in which sparking occurs across the surface of a semiconducting material disposed between the center electrode and an annular ground electrode. All such changes and modifications are intended to be within the scope of the present invention.

We claim:

1. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, and yttrium oxide, wherein the amount of yttrium oxide is less than five percent by volume; and a ground electrode mounted on said housing and terminating at a firing end that is located opposite said firing tip such that said firing end and said firing tip define a spark gap therebetween.

2. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, yttrium oxide, and no more than trace amounts of iridium and ruthenium; and a ground electrode mounted on said housing and terminating at a firing end that is located opposite said firing tip such that said firing end and said firing tip define a spark gap therebetween.

3. An ignition device as defined in claim 2, wherein said firing end of said ground electrode includes a firing tip located opposite the firing tip of said center electrode.

4. An ignition device as defined in claim 3, wherein said firing tips are made of the same alloy.

5. An ignition device as defined in claim 2, wherein said ignition device comprises a spark plug.

6. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, and yttrium oxide; and a ground electrode mounted on said housing and terminating at a firing end that is located opposite said firing tip such that said firing end and said firing tip define a spark gap therebetween;

wherein said alloy is formed from a combination of 91.7–97.99 wt % platinum, 2–8 wt % tungsten, and 0.01%–0.3 wt % yttrium.

7. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, and yttrium oxide; and a ground electrode mounted on said housing and terminating at a firing end that is located opposite said firing tip such that said firing end and said firing tip define a spark gap therebetween;

wherein said alloy is formed from a combination of 95.68–96.12 wt % platinum, 3.8–4.2 wt % tungsten, and 0.08–0.12 wt % yttrium.

8. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, and yttrium oxide; and a ground electrode mounted on said housing and terminating at a firing end that is located opposite said firing tip such that said firing end and said firing tip define a spark gap therebetween;

wherein said firing end of said ground electrode includes a firing tip located opposite the firing tip of said center electrode; and wherein said firing tips are each formed from a combination of 91.7–97.99 wt % platinum, 2–8 wt % tungsten, and 0.01%–0.3 wt % yttrium.

9. An ignition device for an internal combustion engine, comprising:

a housing;

an insulator secured within said housing and having an exposed axial end at an opening in said housing;

a center electrode mounted in said insulator and extending out of said insulator through said axial end, said center electrode including a firing tip formed from an alloy containing platinum, tungsten, and yttrium oxide; and a ground electrode mounted on said housing and terminating at a firing end that is located opposite said firing tip such that said firing end and said firing tip define a spark gap therebetween;

wherein said firing end of said ground electrode includes a firing tip located opposite the firing tip of said center electrode; and wherein said firing tips are each formed from a combination of 95.68–96.12 wt % platinum, 3.8–4.2 wt % tungsten, and 0.08–0.12 wt % yttrium.

10. An ignition device for an internal combustion engine, comprising:

a housing;

an insulator secured within said housing;

a center electrode mounted in said insulator and extending out of said insulator through an axial end of said insulator; and a ground electrode mounted on said housing and terminating at a firing end that is located opposite a corresponding end of said center electrode;

wherein at least one of said electrodes includes a firing tip consisting essentially of platinum, tungsten, and yttrium oxide.

11. An ignition device as defined in claim 10, wherein both said electrodes include a firing tip consisting essentially of platinum, tungsten, and yttrium oxide.

12. An ignition device as defined in claim 10, wherein said ignition device comprises a spark plug.

13. An ignition device for an internal combustion engine, comprising:

a housing;

an insulator secured within said housing;

a center electrode mounted in said insulator and extending out of said insulator through an axial end of said insulator; and a ground electrode mounted on said housing and terminating at a firing end that is located opposite a corresponding end of said center electrode;

wherein at least one of said electrodes includes a firing tip consisting essentially of platinum, tungsten, and yttrium oxide; and wherein said firing tip is made from an alloy that is formed from a combination of 91.7–97.99 wt % platinum, 2–8 wt % tungsten, and 0.01%–0.3 wt % yttrium.

14. An ignition device for an internal combustion engine, comprising:

a housing;

an insulator secured within said housing;

a center electrode mounted in said insulator and extending out of said insulator through an axial end of said insulator; and a ground electrode mounted on said housing and terminating at a firing end that is located opposite a corresponding end of said center electrode;

wherein at least one of said electrodes includes a firing tip consisting essentially of platinum, tungsten, and yttrium oxide; and wherein said firing tip is made from alloy that is formed from a combination of 95.68–96.12 wt % platinum, 3.8–4.2 wt % tungsten, and 0.08–0.12 wt % yttrium.

15. A method of manufacturing an electrode for an ignition device having a housing, a second electrode, and an insulator mounted within the housing to support and electrically isolate the two electrodes, the method comprising the steps of:

(a) forming a firing tip from an alloy that includes platinum, tungsten, yttrium oxide, and no more than trace amounts of iridium and ruthenium, (b) forming an electrode from an electrically-conductive material other than said alloy, and (c) welding said firing tip onto an end portion of said electrode to thereby provide said electrode with an integral firing tip that provides an exposed sparking surface for said electrode.

16. The method set forth in claim 15, wherein step (a) further comprises forming said firing tip as a pad, rivet, ball or wire.

17. The method set forth in claim 15, wherein step (c) further comprises welding said firing tip onto an end face of a center electrode.

18. The method set forth in claim 15, wherein step (c) further comprises welding said firing tip onto an end portion of a ground electrode.

19. A method of manufacturing an electrode for an ignition device having a housing, a second electrode, and an insulator mounted within the housing to support and electrically isolate the two electrodes, the method comprising the steps of:

(a) forming a firing tip from an alloy made from a combination of 91.7–97.99 wt % platinum, 2–8 wt % tungsten, and 0.01%–0.3 wt % yttrium, (b) forming an electrode from an electrically-conductive material other than said alloy, and (c) welding said firing tip onto an end portion of said electrode to thereby provide said electrode with an integral firing tip that provides an exposed sparking surface for said electrode.

20. A method of manufacturing an electrode for an ignition device having a housing, a second electrode, and an insulator mounted within the housing to support and electrically isolate the two electrodes, the method comprising the steps of:

(a) forming a firing tip from an alloy made from a combination of 95.68–96.12 wt % platinum, 3.8–4.2 wt % tungsten, and 0.08–0.12 wt % yttrium, (b) forming an electrode from an electrically-conductive material other than said alloy, and (c) welding said firing tip onto an end portion of said electrode to thereby provide said electrode with an integral firing tip that provides an exposed sparking surface for said electrode.

* * * * *